US007004463B2

(12) United States Patent
Eugster et al.

(10) Patent No.: US 7,004,463 B2
(45) Date of Patent: Feb. 28, 2006

(54) CONVEYING ARRANGEMENT FOR PROCESSING PRINTED MATERIAL TO PRINTED PRODUCTS

(75) Inventors: Albert Eugster, Strengelbach (CH); Felix Kramer, Vordemwald (CH)

(73) Assignee: GRAPHA-Holding AG, Hergiswil (CH)

( * ) Notice: Subject to any disclaimer, the term of this patent is extended or adjusted under 35 U.S.C. 154(b) by 91 days.

(21) Appl. No.: 10/077,305

(22) Filed: Feb. 15, 2002

(65) Prior Publication Data

US 2002/0113356 A1 Aug. 22, 2002

(30) Foreign Application Priority Data

Feb. 19, 2001 (EP) ..... 01810166

(51) Int. Cl.
*B24C 1/00* (2006.01)

(52) U.S. Cl. ..... 271/187; 271/315; 271/82

(58) Field of Classification Search ..... 271/187, 271/315, 82

See application file for complete search history.

(56) References Cited

U.S. PATENT DOCUMENTS 4,735,406 A * 4/1988 Weber ..... 270/52.3
4,901,996 A * 2/1990 Schlough ..... 271/10.06
5,046,711 A * 9/1991 Merwarth et al. ..... 271/11
5,277,413 A 1/1994 Boss
5,556,087 A * 9/1996 Gosslinghoff ..... 270/58.18
5,794,929 A * 8/1998 Curley et al. ..... 271/270

FOREIGN PATENT DOCUMENTS

EP 03 809 21 A2 8/1990
EP 03 809 21 B1 8/1990

* cited by examiner

*Primary Examiner*—Gene O. Crawford
*Assistant Examiner*—Mark A. Deuble
(74) *Attorney, Agent, or Firm*—Friedrich Kueffner

(57) ABSTRACT

A conveying arrangement for processing printed material to printed products has a conveying member supplying printed material and an intermediate conveying device with compartments rotating about an axis of rotation and formed by two opposed adjustable plates. The compartments receive the printed material from the conveying member. A synchronously operating conveyor is arranged downstream of the intermediate conveying device and has pocket-shaped receiving elements receiving the printed material from the compartments. The compartments, when approaching the conveying member, are moved into an open position for receiving the printed material and then into a closed position for further transporting the received printed material. The compartments have controllable conveyors arranged opposite one another on the opposed adjustable plates. The conveyors transport frictionally the printed material, clamped therebetween, out of the compartments. A drive acts on the conveyors.

9 Claims, 2 Drawing Sheets

CONVEYING ARRANGEMENT FOR PROCESSING PRINTED MATERIAL TO PRINTED PRODUCTS

BACKGROUND OF THE INVENTION

1. Field of the Invention

The invention relates to a conveying arrangement for processing printed material to printed products such as newspapers, journals, brochures, books or the like. The conveying arrangement is comprised of an intermediate conveying device receiving printed material from a conveying member and transferring it to a synchronously operating conveyor which is arranged downstream and is provided with pocket-shaped receiving elements. The intermediate conveying device comprises compartments rotating about at least one axis and formed by at least two opposed adjustable plates which in the approach area of the conveying member can be moved into an open position and then into a closed position for the further transport of the received printed material.

2. Description of the Related Art

Such a conveying arrangement is described, for example, in European patent document EP 0 380 921 B1. In this arrangement, the printed material which is supplied for processing while being suspended by a conveying member, for example, a transporting device, is received in the transfer area by a wheel with compartments which is driven in the same direction. Upon undergoing a rotational movement of approximately 180°, during which the printed material remains clamped within the compartments, the printed material is transferred from the open compartments into pockets of an insertion machine which is driven approximately in the same direction in the transfer area as the conveying member. During this transfer, the printed material, after release of the clamping action in the compartments, is accelerated by the centrifugal force generated by the rotating wheel and the acting gravitational force; when the production output is increased, this acceleration is also considerably increased. The reliability of processing is thus questionable.

SUMMARY OF THE INVENTION

It is an object of the present invention to provide a conveying arrangement with which a high production output can be obtained without the product quality and the processing reliability suffering.

In accordance with the present invention, this is achieved in that on the plates of a compartment controllable conveying means are arranged which are opposed to one another and transport frictionally the printed material clamped therebetween out of the compartment and are connectable to a drive device. In this way, the printed material can be supplied in a controlled way to the downstream conveyor or an insertion machine.

As a result of an immersion of the free compartment ends into the pocket-shaped receiving elements, the free fall of the printed material can be shortened. It is also possible, for example, for lightweight printed material to release the printed sheets, without use of the conveying means in the compartments, by prematurely opening the compartments.

Preferably, at least on one plate of the compartments the conveying means is fastened so as to be liftable in a yielding way relative to the other conveying means, respectively, relative to the clamped printed material so that mass deviations with respect to the thickness of the printed material are tolerable.

Advantageously, the conveying means are rollers and the drive device is a stationery roller path acting on a roll configured as drive roller. This configuration provides a simple realization of the conveying device in the compartment.

Expediently, the roller path and/or the drive roller have a yielding roller covering by which dimensional errors can be compensated.

Alternatively, the roller path can be arranged relative to the drive roller so as to be yielding so that inaccuracies can be compensated.

It is moreover also beneficial when the roller path is provided between its inlet section and exit section with a friction section concentrically arranged relative to the axis of rotation of the intermediate conveying device.

For adaptation to printed products of different thickness it is suggested that the spacing of the plates of closed compartments is adjustable.

In the following, the invention will be explained with the aid of one embodiment shown in the drawing, wherein reference is being had to the drawing specifically in regard to features not described in detail in the specification.

DESCRIPTION OF THE PREFERRED EMBODIMENTS

Figure 1:
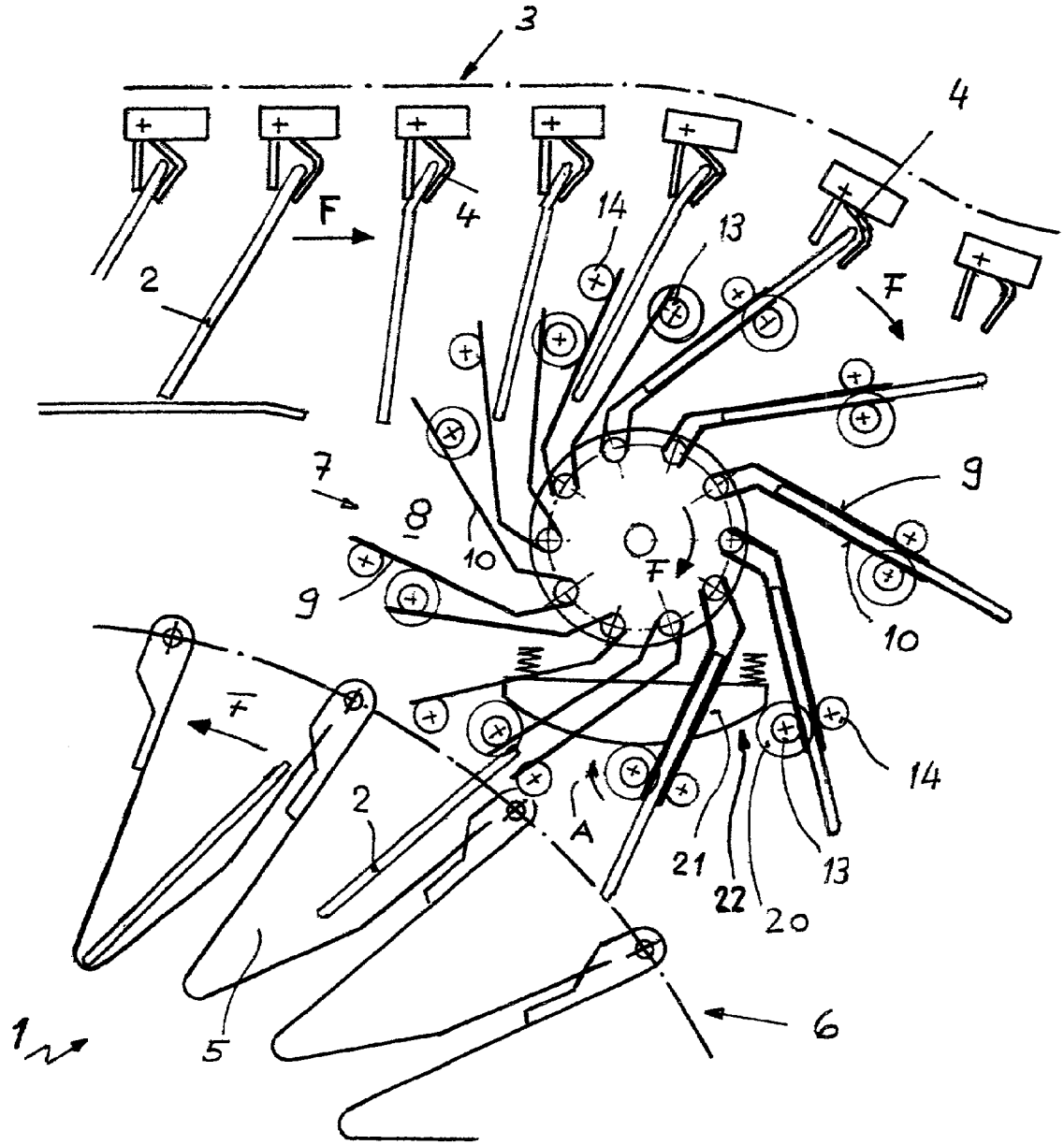
FIG. 1 shows a side view of a conveying arrangement.

FIG. 1 shows a conveying arrangement 1 according to the invention for processing printed material 2 to form printed products. The printed material 2 are supplied, suspended on clips 4, by the conveying member 3 or transporting device. In the present case, the pieces of printed material 2 are gripped by the clips 4 at the folded edge and, after undergoing a turning movement in an intermediate conveying device 7, are received in pockets 5 of an insertion machine 6, shown only partially. This is described and illustrated also in the aforementioned European patent document 0 380 921 B1. When the pieces of printed material 2 are received by the intermediate conveying device 7, a process takes place according to which each piece of printed material 2 first is threaded into a compartment 8 formed by two plates 9, 10 and, subsequently, when the compartment 8 approaches the conveying member 3 more closely and the printed material 2 has penetrated deeper into the compartment 8, is released from the clip 4 by an opening action of the clip 4. The arrows F indicate the movement direction of the devices for transporting the printed material 2. The present conveying arrangement, of course, can also be used for a different processing step such that the pieces of printed material 2 are gripped by means of the clips 4 at the open edge opposite the folded edge and transferred in this configuration to an intermediate conveying member 7.

Figure 3:
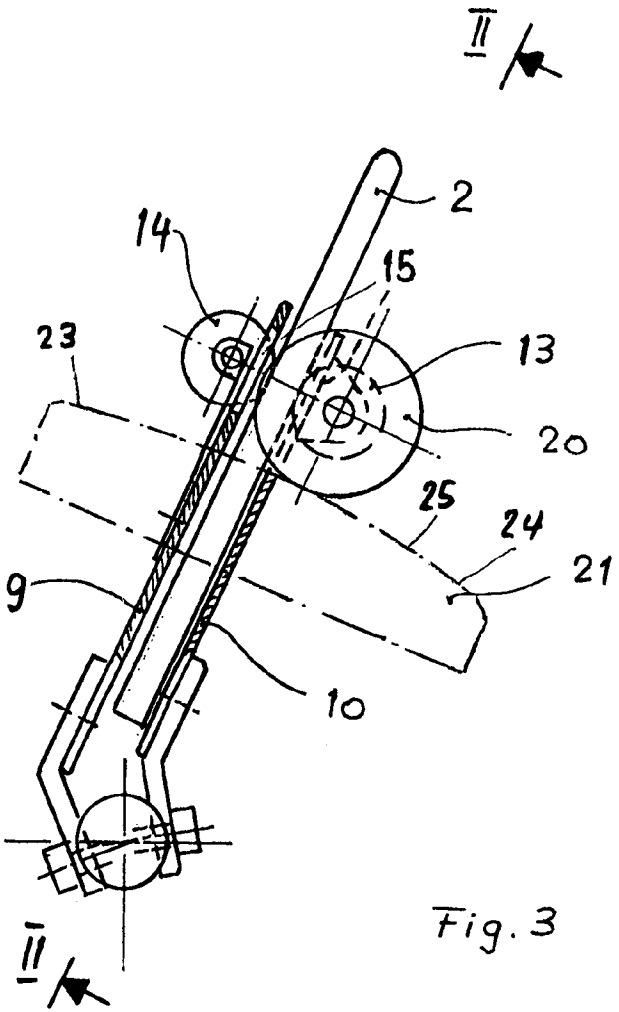
FIG. 3 shows an enlarged illustration of a compartment illustrated in FIG. 1.
Figure 2:
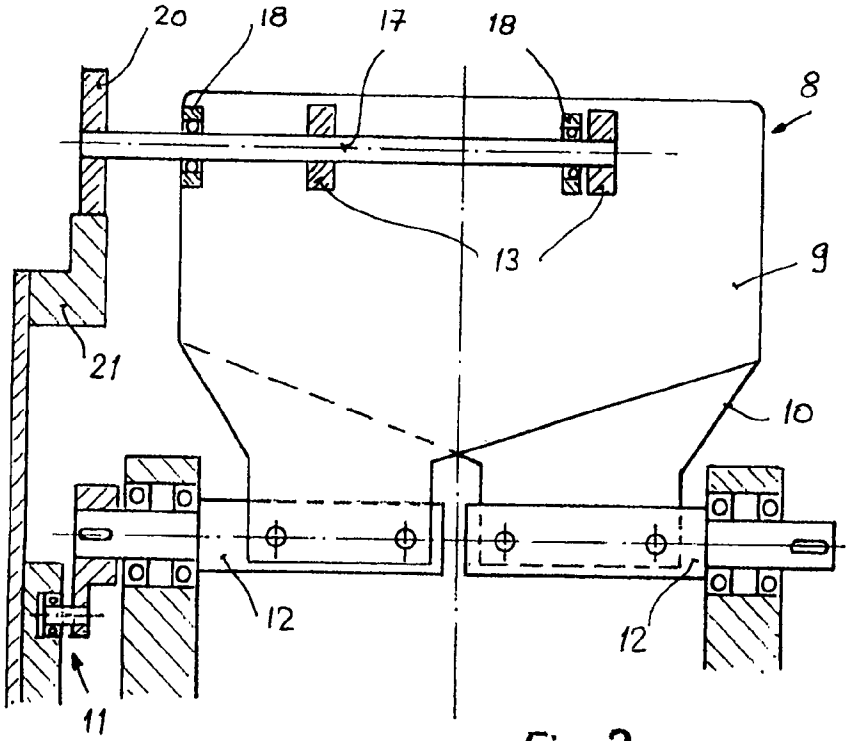
FIG. 2 shows a cross-section according to section line II—II of FIG. 3.

The compartments 8 have an outer receiving part for the printed material 2 which in the conveying direction is angled relative to the radial alignment. This arrangement of the compartment 8, or of the pivotable plates 9, 10 forming the compartment 8, is beneficial for the transfer of the printed material 2 from the clips 4 of the conveying member 3. The plate movements are realized also by a connecting linkcontrolled pivot device 11, shown in FIG. 2, which is in driving connection with a shaft 12 of one of the plates 9, 10. Further details of the plate drive can also be taken from the aforementioned European patent document 0 380 921 B1, which corresponds to U.S. Pat. No. 5,110,108, which is incorporated herein by reference. The compartments 8 reach the trajectory of the pieces of printed material 2, suspended from the conveying member 3, in the open state, as indicated in FIG. 1, and are closed again directly after opening of the clips 4 (see FIG. 1) so that between the plates 9, 10 a spacing remains which corresponds to the thickness of the pieces of printed material 2 and the printed material 2 are initially secured in the compartments 8 by two opposed conveying means, e.g., rollers 13, 14 which are fastened on the plates 9, 10 (see also FIG. 3). For this purpose, the plates 9, 10 have a through opening 15 correlated with a corresponding roller 13, 14 through which roller pairs 13, 14, connected by means of a drive shaft 17, project into the gap so that they impact on a piece of printed material 2. The supporting action of the paired rollers 13, 14 fastened on the drive shaft 17 is provided by bearings 18, 19 which are arranged on the external side of the plates 9, 10.

The plates 9, 10, pivotably supported on a hub 16, rotate in the direction of the arrow F together with the printed material 2 secured by the rollers 13, 14 in the compartment 8. Because of the tolerances that are present, one roller 13 or roller pair 13 is supported in a yieldingly arranged bearing 18.

On the drive shaft 17, projecting with one end past the plate 9 or 10 of a compartment 8, a drive roller 20 is fastened which upon contacting a stationary drive device 21 begins to rotate and conveys the printed material 2 out of the compartments 8. The drive device 21 has a roller path 22 which has a friction section 25 between the inlet section 23 and exit section 24. The friction section 25 imparts onto the drive roller 20 a rotational movement in the direction A so that the printed material 2 is conveyed by rollers 13, 14 out of the compartments 8. The latter remain closed up to the point when the printed material 2 leaves the compartment or can be open shortly beforehand, wherein the printed material 2, now released by the rollers 13, 14, fall out of the compartment 8.

For compensation of inaccuracies or for exerting a permanent rolling friction, the drive device 21 is supported in a springy fashion and the friction section 25 of the roller path 22 extends concentrically relative to the axis of rotation 26 of the intermediate conveying device 7.

While specific embodiments of the invention have been shown and described in detail to illustrate the inventive principles, it will be understood that the invention may be embodied otherwise without departing from such principles.

What is claimed is:

1. A conveying arrangement for processing printed material to printed products, the conveying arrangement comprising:

a conveying member supplying printed material;

an intermediate conveying device comprising compartments rotating about at least one axis of rotation and formed by at least two opposed adjustable plates, wherein the compartments are configured to receive the printed material from the conveying member;

a synchronously operating feeder arranged downstream of the intermediate conveying device and having pocket-shaped receiving elements configured to receive the printed material from the compartments;

wherein the compartments, when approaching the conveying member, are moved into an open position for receiving the printed material and then into a closed position for further transporting the received printed material;

wherein the compartments comprise controllable conveying means arranged opposite one another on the at least two opposed adjustable plates, wherein the conveying means are configured to transport frictionally the printed material, clamped between the conveying means, out of the compartment; and a drive configured to act on the conveying means, the at least two opposed adjustable plates having through openings, the conveying means including rollers and the drive comprising a stationary roller path and a drive roller connected to the rollers and acted on by the roller path, the rollers act via the through openings on the printed material, wherein the roller path is arranged so as to yield relative to the drive roller.

2. The conveying arrangement according to claim 1, wherein the rollers of at least one of the at least two opposed adjustable plates are configured to be liftable.

3. The conveying arrangement according to claim 1, wherein at least one of the roller path and the drive roller has a yielding cover.

4. A conveying arrangement for processing printed material to printed products, the conveying arrangement comprising:

a conveying member supplying printed material;

an intermediate conveying device comprising compartments rotating about at least one axis of rotation and formed by at least two opposed adjustable plates, wherein the compartments are configured to receive the printed material from the conveying member;

a synchronously operating feeder arranged downstream of the intermediate conveying device and having pocket-shaped receiving elements configured to receive the printed material from the compartments;

wherein the compartments, when approaching the conveying member, are moved into an open position for receiving the printed material and then into a closed position for further transporting the received printed material;

wherein the compartments comprise controllable conveying means arranged opposite one another on the at least two opposed adjustable plates, wherein the conveying means are configured to transport frictionally the printed material, clamped between the conveying means, out of the compartment; and a drive configured to act on the conveying means, the at least two opposed adjustable plates having through openings, the conveying means including rollers and the drive comprising a stationary roller path and a drive roller connected to the rollers and acted on by the roller path, the rollers act via the through openings on the printed material, wherein the drive is adjustable relative to a transfer position of the printed material.

5. The conveying arrangement according to claim 4, wherein the rollers of at least one of the at least two opposed adjustable plates are configured to be liftable.

6. The conveying arrangement according to claim 4, wherein at least one of the roller path and the drive roller has a yielding cover.

7. A conveying arrangement for processing printed material to printed products, the conveying arrangement comprising:

a conveying member supplying printed material;

an intermediate conveying device comprising compartments rotating about at least one axis of rotation and formed by at least two opposed adjustable plates, wherein the compartments are configured to receive the printed material from the conveying member;

a synchronously operating feeder arranged downstream of the intermediate conveying device and having pocket-shaped receiving elements configured to receive the printed material from the compartments;

wherein the compartments, when approaching the conveying member, are moved into an open position for receiving the printed material and then into a closed position for further transporting the received printed material;

wherein the compartments comprise controllable conveying means arranged opposite one another on the at least two opposed adjustable plates, wherein the conveying means are configured to transport frictionally the printed material, clamped between the conveying means, out of the compartment; and a drive configured to act on the conveying means, the at least two opposed adjustable plates having through openings, the conveying means including rollers and the drive comprising a stationary roller path and a drive roller connected to the rollers and acted on by the roller path, the rollers act via the through openings on the printed material, wherein the roller path comprises sequentially arranged an inlet section, a friction section, and an exit section, wherein the friction section is concentric to the at least one axis of rotation of the intermediate conveying device.

8. The conveying arrangement according to claim 7, wherein the rollers of at least one of the at least two opposed adjustable plates are configured to be liftable.

9. The conveying arrangement according to claim 7, wherein at least one of the roller path and the drive roller has a yielding cover.

* * * * *